US005232804A

United States Patent [19]

Molaire

[11] Patent Number: 5,232,804

[45] Date of Patent: Aug. 3, 1993

[54] ELECTROPHOTOGRAPHIC ELEMENT AND METHOD OF MAKING SAME

[75] Inventor: Michel F. Molaire, Rochester, N.Y.

[73] Assignee: Eastman Kodak Company, Rochester, N.Y.

[21] Appl. No.: 816,364

[22] Filed: Dec. 31, 1991

[51] Int. Cl.[5] ..... G03G 5/09; G03G 5/06

[52] U.S. Cl. ..... 430/83; 430/75; 430/130; 430/134

[58] Field of Search ..... 430/75, 83, 130, 134

[56] References Cited

U.S. PATENT DOCUMENTS

| | | | |
|---|---|---|---|
| 3,615,396 | 10/1971 | Gramza et al. | 430/83 X |
| 4,350,751 | 9/1982 | Contois | 430/135 |
| 4,971,873 | 11/1990 | Pavlisko et al. | 430/58 |
| 4,985,326 | 1/1991 | Sakamoto | 430/96 |

OTHER PUBLICATIONS

T. G. Fox, *Bull. Amer. Phys. Soc.*, vol. 1, 1956, p. 123.

*Primary Examiner*—Roland Martin

*Attorney, Agent, or Firm*—Nixon, Hargrave, Devans and Doyle

[57] ABSTRACT

An electrophotographic element comprises a single aggregate photoconductive layer which contains a continuous phase that has a high glass transition temperature $T_g$, of at least about 110° C. The required high glass transition temperatures can be obtained by using compositions for the aggregate photoconductive layer that contain organic charge transport agents with high glass transition temperatures or polymer binders with high glass transition temperatures, or combinations of both. In a preferred embodiment an aggregating bisphenol A polycarbonate is used in combination with a cobinder polymer that has a high glass transition temperature. The electrophotographic element of the invention can be dried at temperatures of at least about 100° C., and preferably from about 110° C. to about 145° C., to eliminate the solvent used in coating. The dried photoconductive layer exhibits good physical properties and excellent photographic performance, which remains stable with continued use.

17 Claims, No Drawings

ELECTROPHOTOGRAPHIC ELEMENT AND METHOD OF MAKING SAME

FIELD OF THE INVENTION

This invention relates to a novel electrophotographic element containing a single aggregate photoconductive layer and to a method for making such elements.

BACKGROUND OF THE INVENTION

Photoconductive elements, also called photoreceptors, are composed of a conducting support and at least one photoconductive layer which is insulating in the dark but which becomes conductive upon exposure to actinic radiation. To form images, the surface of the element is electrostatically uniformly charged in the dark and then exposed to a pattern of actinic radiation. In areas where the photoconductive layer is irradiated, mobile charge carriers are generated which migrate to the surface and dissipate the surface charge in such areas. The resulting charge pattern on the surface is referred to as an electrostatic latent image. The latent image can be made visible by application of a liquid or dry developer containing finely divided charged toner particles which, if desired, can be transferred and fixed to another surface such as a sheet of paper.

Numerous photoconductive materials have been described as being useful in electrophotography. These include inorganic substances, such as selenium and zinc oxide, and organic compounds, both monomeric and polymeric, such as arylamines, arylmethanes, carbazoles, pyrroles, phthalocyanines and the like. Especially useful are aggregate photoconductive compositions that have a continuous electrically insulating polymer phase containing a finely divided, particulate co-crystalline complex of at least one pyrylium-type dye salt and at least one polymer having an alkylidenediarylene group in a recurring unit.

Aggregate compositions used in photoreceptors can be prepared by several techniques, such as, for example, the "dye first" technique described in Gramza et al., U.S. Pat. No. 3,615,396, incorporated herein by reference. Alternatively, they can be prepared by the "shearing" method described in Gramza, U.S. Pat. No. 3,615,415, incorporated herein by reference. This latter method involves the high speed shearing of the photoconductive composition prior to coating and thus eliminates subsequent solvent treatment, as disclosed in Light, U.S. Pat. No. 3,615,414, referred to hereinafter. By whatever method prepared, the aggregate composition is applied with a suitable liquid coating vehicle onto a support or underlying layer to form a separately identifiable multiphase aggregate composition, the heterogeneous nature of which is generally apparent when viewed under magnification, although such compositions may appear to be uniform to the naked eye in the absence of magnification. There can, of course, be macroscopic heterogeneity. Suitably, the pyrylium type dye-salt-containing aggregate in the discontinuous phase is finely-divided, i.e., typically predominantly in the size range of from about 0.01 to about 25 μm.

Photoconductive elements can comprise single or multiple active layers. In a single layer photoconductive element charge generation and charge transport take place within the same layer. Single active layer aggregate photoconductive elements are described in Light, U.S. Pat. No. 3,615,414 and in Gramza et al., U.S. Pat. Nos. 3,732,180 and 3,615,415. Contois and Rossi, U.S. Pat. Nos. 3,873,312 and 3,873,311 describe the use of aggregate photoconductive compositions and elements containing organic photoconductors with a styrylamino structure. Berwick et al., U.S. Pat. No. 4,175,960, describes a multi-active photoconductive element having an aggregate charge generation layer.

Single active layer aggregate photoconductive compositions have found many commercial applications. They are easily and inexpensively manufactured and have the additional advantage of being able to photoconduct to either a negatively or positively charged surface.

A single active layer aggregate Photoconductive composition intended for coating in a drum format differs in certain respects from one intended for web coating. In particular, drum coating requires the use of higher boiling solvents in the formulation to promote good coating uniformity. However, because the coating substrate is mounted in a vertical position during coating, drying conditions must be carefully controlled to maintain end to end thickness uniformity. Formulations for drum coatings typically contain 1,1,2-trichloroethane as a solvent, and coated drums are generally dried in a convection oven set at a temperature of about 90° C. to volatilize this solvent. It would be desirable to employ higher temperatures to remove the solvent completely, but it has been found that drying temperatures above 100° C. have a detrimental effect on the electrophotographic speed of a single active layer aggregate photoconductor.

Essentially solvent-free photoconductive drum coatings are desirable for several reasons. First, residual solvent is capable of plasticizing a coating, adversely affecting its physical properties and diminishing its durability. In addition, the presence of a small amount of residual solvent that is slowly volatilized with continuing use of the coating can lead to unstable electrophotographic performance.

In commercial electrophotographic copying machines, especially those of compact design where drum photoconductors are typically employed, internal temperatures increase greatly, as much as 70° C., during a long run job. Because of the heat capacity and thermal conductivity of aluminum, the metal most commonly used for drum substrates, the photoconductive layer quickly equilibrates with the hot environment. Continued drying, with consequent change in the electrophotographic performance of the single active layer aggregate photoconductor, is the result.

Thus, a need exists for single active layer aggregate photoconductors, particularly in a drum format, which can be dried at a high enough temperature, at least about 100° C., and preferably from about 110° C. to 145° C., to ensure complete removal of coating solvent and form a photoconductive layer with good physical properties and excellent, stable electrophotographic performance.

BRIEF SUMMARY OF THE INVENTION

The electrophotographic element of the invention comprises a single active photoconductive layer on an electrically conductive support, wherein the photoconductive layer comprises an electrically insulating, continuous polymer phase in which is heterogeneously dispersed a complex of at least one high molecular weight aggregating binder polymer having an alkylidenediarylene group in a recurring unit and at least one aggregating pyrylium dye salt, and which additionally contains at least one organic charge transport agent; the continuous polymer phase of the photoconductive layer has a glass transition temperature, $T_g$, of at least about 110° C.

The electrophotographic element of the invention, which is particularly useful in a drum format, can be dried at a temperature of about 110° C. to eliminate completely the solvent used in coating. The dried coating exhibits good physical properties and excellent electrophotographic performance, which remains stable with continued use.

The electrophotographic element of the invention is formulated such that the glass transition temperature, or $T_g$, of its continuous phase is at or above the desired drying temperature, that is, about 110° C. The term "glass transition temperature" or "$T_g$" as used herein means the temperature at which a polymer layer changes from a solid to a viscous liquid or a rubbery state. The required glass transition temperature of the continuous phase can be achieved by using either organic charge transport agents with high glass transition temperatures or binder polymers with high glass transition temperatures, or combinations of both. The single active aggregate layers of the invention most readily form with a polycarbonate aggregating binder. In a preferred embodiment, the binder polymer is bisphenol A polycarbonate, which has a glass transition temperature of about 145° C. To achieve a photoconductive layer whose continuous phase has a Tg of at least about 110° C. from a formulation containing bisphenol A polycarbonate as the aggregating binder requires inclusion of at least one additional polymer binder with a high $T_g$ of at least about 195° C. It is essential that any additional polymer binders used in the photoconductive layer formulations be compatible with bisphenol A polycarbonate. Polymers with high glass transition temperatures useful for inclusion in formulations with bisphenol A polycarbonate include certain of its derivatives, in particular polyhalogenated derivatives, as well as other polycarbonates and polyesters.

DETAILED DESCRIPTION OF THE INVENTION

As used herein, the following terms have the meanings indicated:

An "aggregate photoconductive material" is a material containing a finely divided, particulate photoconductive co-crystalline complex of at least one aggregating dye salt and at least one aggregating binder polymer.

An "aggregating dye" is a dye salt, preferably of the pyrylium type, that forms a photoconductive co-crystalline complex with an aggregating binder polymer.

An "aggregating binder polymer" is a polymer having an alkylidenediarylene repeating unit, preferably a polycarbonate, that forms a photoconductive co-crystalline complex with an aggregating dye.

A "seed composition" is a composition containing small preformed dye-polymer aggregate particles that are nucleating sites for the formation of a particulate photoconductive co-crystalline complex of aggregating dye salt and aggregating binder polymer.

In the manufacture of the photoconductive elements of the invention, a specifically prepared aggregate photoconductive composition is coated and dried on an electrically conductive substrate. The latter can be in the form of a plate, sheet or web, but most advantageously in accordance with the invention is a cylindrical drum, for example, a metallic drum or a nonmetallic drum that has an electrically conductive surface.

In a preferred method for preparing the aggregate composition in the method of the invention, one or more binder polymers, at least one of which is an aggregating polymer, are dissolved in an organic solvent. To this mixture is added a seed composition, which contains small preformed aggregate particles that are nucleating sites for the formation of the dye-polymer aggregate composition. To the resulting mixture are added selected aggregating dyes, organic charge transport agents and, preferably, a coating aid.

Pyrylium type dye salts, especially thiapyrylium and selenapyrylium dye salts, are useful in forming the aggregate compositions. Useful dyes are disclosed in Light, U.S. Pat. No. 3,615,414, incorporated herein by reference.

Particularly useful in forming the aggregates are pyrylium dye salts having the formula:

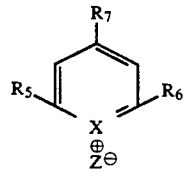

wherein:

$R_5$ and $R_6$ are phenyl groups;

$R_7$ is a dimethylaminosubstituted phenyl group;

X is selenium, sulfur or tellurium; and

Z is an anion such as perchlorate, tetrafluoroborate or hexafluorophosphate.

The polymers useful in forming the aggregate compositions are electrically insulating, film-forming polymers having an alkylidenediarylene group in a recurring unit such as those linear polymers, disclosed in Light, U.S. Pat. No. 3,615,414 and Gramza et al., U.S. Pat. No. 3,732,180, incorporated herein by reference.

Preferred polymers for forming aggregate compositions are hydrophobic carbonate polymers containing the following group in a recurring unit:

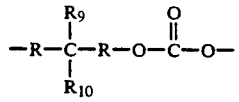

wherein each R is a phenylene group; and $R_9$ and $R_{10}$ are each methyl or, taken together, represent a norbornyl group. Such compositions are disclosed, for example, in U.S. Pat. Nos. 3,028,365 and 3,317,466. Especially preferred are polycarbonates prepared with bisphenol A. A wide range of film-forming polycarbonate resins are useful, with satisfactory results being obtained when using commercial polymeric materials which are characterized by an inherent viscosity of about 0.5 to about 1.8. Specific examples of useful polymers for the aggregate compositions are listed in Table I, Column 13 of U.S. Pat. No. 4,108,657, incorporated herein by reference.

The choice of high $T_g$ binders useful for achieving the high $T_g$ aggregate layers of this invention requires compatibility with bisphenol A polycarbonates. Some useful polymers include polycarbonates made from derivatives of bisphenol A, such as tetrachlorobisphenol A, tetrabromobisphenol A, and tetramethyl bisphenol A. Polyesters of bisphenol A and its derivatives and analogs are also useful. Other electrically insulating polymers suitable as cobinders for the high $T_g$ single active layer aggregate coatings of this invention include those having recurring units derived from:

(a) Phenylindans such as the phenylindan dicarboxylates of U.S. Pat. No. 3,634,089, the phenylindan diols of Research Disclosure, Vol. 118, Item 11833, February, 1974, published by Industrial Opportunities Limited, Homewell, Havant, Hampshire, PO9 1EF, United Kingdom: and U.S. Pat. Nos. 3,803,096, 3,859,364, and 3,886,124; the phenylindan diamines of U.S. Pat. Nos. 3,897,253 and 3,915,939 and the hydrogenated phenylindans of U.S. Pat. Nos. 3,769,264, 3,842,042 and 3,873,320;

(b) The polyester-amide precursors of J. C. Wilson, Research Disclosure, Vol. 128, Item 12833, December, 1974;

(c) The 1,1'-spirobiindandicarboxylates of U.S. Pat. No. 3,725,070; and the 1,1'-spirobiindanbis (oxyacetates) of Research Disclosure, Vol. 98, Item 9830, June 1972;

(d) The 1,1'-spirobiindan-5,5'-diamines of Research Disclosure, Vol. 131, Item 13117, March, 1975;

(e) The 2,2'-spirobichromans of U.S. Pat. No. 3,859,097;

(f) The 7,7-dimethyl-7H-dibenzo(c,h)xanthenes of U.S. Pat. Nos. 3,859,254 and 3,902,904;

(g) The 9.9-dimethylxanthene-3,6-bis(oxyacetates) of Research Disclosure, Vol. 98, Item 9830, June, 1970;

(h) The 4,4'-(3-phenyl-1-indanylidene)diphenols of Research Disclosure, Vol. 131, Item 13101, March, 1975;

(i) The 4,4'-(hexahydro-4,7-methanoindan-5-ylidene)-diphenols of Research Disclosure, Vol. 135, Item 13568, July, 1975;

(j) The bisphenols of Research Disclosure, Vol. 120, Item 12012, April, 1974, and the halogenated bisphenols of Research Disclosure, Vol. 135, Item 13569, July, 1975;

(k) The sulfonyldibenzoates of Research Disclosure, Vol. 140, Item 14016, December, 1975;

(l) The polycyclic norbornanes of Research Disclosure, Vol. 135, Item 135070, July, 1975.

The Tg of the cobinder polymer usually is higher than that of the aggregating binder so that the continuous polymer phase of the photoconductive layer has a $T_g$ of at least about 110° C. Where bisphenol A polycarbonate, which has a Tg of about 145° C., is used as the aggregating binder, the $T_g$ of the cobinder polymer has to be at least about 50° C. higher, that is, at least about 195° C.

In addition to using a combination of an aggregating binder such as bisphenol A polycarbonate with a cobinder polymer that has a high $T_g$, there are several other ways of making a single active layer aggregate coating whose continuous polymer phase has a glass transition temperature of at least about 110° C. For example, a formulation for such a coating can contain an aggregating binder polymer with a very high $T_g$ together with one or more organic charge transport agents. Alternatively, an aggregating binder such as bisphenol A polycarbonate can be combined in a formulation with one or more organic charge transport agents having high $T_g$s. This formulation can include a highly efficient organic charge transport agent with a low glass transition temperature if it is blended with other organic charge transport agents with very high $T_g$s.

The aggregate compositions of the invention are prepared from a mixture comprising at least one binder polymer, at least one of which is an aggregating polycarbonate, and at least one aggregating pyrylium dye salt and at least one organic charge transfer agent. Once the aggregate is formed, it is not possible to isolate the amorphous phase from the aggregate phase. It can be assumed, however, that the chemical composition of the amorphous phase is not substantially different from that of starting composition minus the aggregating dye, which is in low concentration. Thus it is possible to determine the $T_g$ of the continuous phase of the aggregate layer to a close approximation by using one of the empirical equations well known in the art to calculate the $T_g$ of the amorphous phase from the $T_g$s of the individual components and their concentrations. One such equation is the Fox equation (T. G. Fox, *Bull. Amer. Phys. Soc.*, Vol. 1, 1956, p. 123):

$$1/T_g = w_1/T_{g1} + w_2/T_{g2} + w_3/T_{g3} \ldots + w_n/T_{gn}$$

where n is the total number of individual components in a mixture, $T_{g1}$, $T_{g2}$, $T_{g3}$, . . . , $T_{gn}$ are the glass transition temperatures of the individual components expressed in degrees Kelvin, and $w_1$, $w_2$, $w_3$, . . . $w_n$ are the weight fractions of the individual components.

Table 1 below shows results of such calculations according to the Fox equation for the amorphous phase of single layer aggregate photoconductors for various formulations, where n, the number of components, represents the total number of binder polymers and organic charge transport agents in a given formulation.

The $T_g$s of the amorphous phase of the single layer aggregate electrophotographic elements of the invention in the tables and examples hereinafter were calculated from the Fox equation. $T_g$s of the individual components of the photoconductive layers were determined by techniques such as differential scanning calorimetry or differential thermal analysis, as disclosed in Mott, N. F. and Davis, E. A., *Electronic Processes in Non-Crystalline Material,* Oxford University Press, Belfast, 1971, p. 192.

TABLE 1

Glass Transition Temperatures Calculated by the Fox Equation for the Amorphous Phase of Aggregate Photoconductive Materials

| Component | $T_g$ (°C.) | Weight Fraction of Component | | | | | | | | | | | |
|---|---|---|---|---|---|---|---|---|---|---|---|---|---|
| "Lexan 145" polycarbonate | 145 | .3 | .3 | .3 | .3 | .3 | .3 | .3 | .3 | .3 | .18 | .3 | .3 |
| "Makrolon 5705" polycarbonate | 145 | .3 | .3 | — | — | — | — | .3 | .3 | — | — | — | — |
| Tetrachlorobisphenol A polycarbonate | 239 | — | — | .3 | .3 | .3 | .3 | — | — | .3 | .42 | — | — |
| 4,4'-(Hexahydro-4,7-methano)-indan-5-ylidene)bisphenol polycarbonate | — | — | — | — | — | — | — | — | — | — | — | .3 | — |
| 4,4'-(Hexahydro-4,7-methano)- | — | — | — | — | — | — | — | — | — | — | — | — | .3 |

TABLE 1-continued

| Component | $T_g$ (°C.) | Glass Transition Temperatures Calculated by the Fox Equation for the Amorphous Phase of Aggregate Photoconductive Materials — Weight Fraction of Component | | | | | | | | | | | | |
|---|---|---|---|---|---|---|---|---|---|---|---|---|---|---|
| indan-5-ylidene)bisphenol polyterephthalate | | | | | | | | | | | | | | |
| 1,1-Bis(di-4-tolylamino phenyl-cyclohexane | 63 | .2 | .15 | .15 | .15 | .3 | — | .2 | .25 | — | .15 | .15 | .15 |
| Tri-4-tolylamine | −4 | .2 | .15 | .15 | — | — | .3 | — | — | .35 | — | — | — |
| 1,4-Bis(di-4-tolylamino styryl)benzene | 74 | — | .1 | .1 | .1 | .1 | .1 | .1 | .1 | .05 | .1 | .1 | .1 |
| 1,4-Bis(di-4-tolylamino phenyl)3-n-propylbenzene | 82 | — | — | — | .15 | — | — | .1 | .05 | — | .15 | .15 | .15 |
| Calculated $T_g$ (°C.) | | 88 | 94 | 112 | 133 | 137 | 96 | 111 | 111 | 91 | 142 | 138 | 146 |

Preferred organic charge transport agents are triarylamines such as tri-p-tolylamine and amino-substituted polyarylalkane photoconductors represented by the formula;

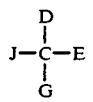

wherein D and G, which may be the same or different, represent aryl groups and J and E, which may be the same or different, represent a hydrogen atom, an alkyl group, or an aryl group, at least one of D, E and G containing an amino substituent. Especially useful is a polyarylalkane wherein J and E represent a hydrogen atom, an aryl, or an alkyl group, and D and G represent substituted aryl groups having as a substituent thereof a diarylamino group wherein the aryl groups are groups such as tolyl. Additional information concerning certain of these latter polyarylalkanes can be found in Rule et al., U.S. Pat. No. 4,127,412.

The aggregate composition of the invention is filtered and coated on a substrate. Any technique for coating these uniform layers on a substrate can be used. When the substrate is a flat surface such as a sheet, plate or web, suitable coating methods include extrusion hopper coating, curtain coating, reverse roll coating and the like. For coating a drum substrate, a ring coater of known type advantageously is used. After coating, the photoconductive layer on the substrate is dried, for example, by heating in an oven at a temperature above about 100° C., and preferably from about 110° C. to about 145° C.

The following examples further illustrate the invention:

All formulations of the examples for the aggregate photoconductive layers were prepared at room temperature. The aggregating dyes were first dissolved in the solvent mixture; the binding polymers and organic charge transport agents were then added. After all the materials were in solution, the seed was added. A phenylmethylsubstituted siloxane with a viscosity of 50 centistokes ("DC-510 polysiloxane," obtained from Dow Corning) was used as a coating aid in all formulations. The resulting solutions were filtered first through a 2.5 μm, then through a 0.6 μm filter.

The formulations used in the examples are listed in Tables A, B, C and D below. Those shown in Table A, which contain variations in aggregating binder polymer and cobinder polymer with high $T_g$, were coated on a web support. The coatings were subsequently cut into strips, which were wrapped around an aluminum drum for evaluation.

TABLE A

| | Aggregate Photoconductive Material Formulations — Example 1 A-1 | | Example 2 A-2 | | Example 3 A-3 | |
|---|---|---|---|---|---|---|
| | Grams | Wt % | Grams | Wt % | Grams | Wt % |
| "Lexan 145" polycarbonate | 35.64 | 52.85 | 17.82 | 26.42 | 17.82 | 26.42 |
| "Makrolon 5705" polycarbonate | 0 | 0 | 17.82 | 26.42 | 0 | 0 |
| Tetrachloro-bisphenol A polycarbonate | 0 | 0 | 0 | 0 | 17.82 | 26.42 |
| Seed | 1.32 | 1.96 | 1.32 | 1.96 | 1.32 | 1.96 |
| Polyester DMT/EG/NPG* | 1.32 | 1.96 | 1.32 | 1.96 | 1.32 | 1.96 |
| 4((4-Dimethyl-aminophenyl)2, 6-diphenyl) 6-phenylthia-pyrylium hexa-fluorophosphate | 2.11 | 3.13 | 2.11 | 3.13 | 2.11 | 3.13 |
| 4(4-Dimethyl-aminophenyl)2-(4-ethoxyphenyl) 6-phenylthia-pyrylium tetra-fluoroborate | 0.53 | 0.79 | 0.53 | 0.79 | 0.53 | 0.79 |
| 1,1-Bis(di-4-tolylamino-phenyl)cyclohexane | 11.88 | 17.62 | 11.88 | 17.62 | 11.88 | 17.62 |
| 4,4'-Bis(diethyl-amino-tetra-phenylmethane | 2.64 | 3.91 | 2.64 | 3.91 | 2.64 | 3.91 |
| Tri-4-tolylamine | 11.88 | 17.62 | 11.88 | 17.62 | 11.88 | 17.62 |
| DC-510,phenyl-methyl substituted siloxane | 0.12 | 0.18 | 0.12 | 0.18 | 0.12 | 0.18 |
| Dichloromethane | 378 | | 378 | | 378 | |
| 1,1,2-Trichloro-ethane | 160 | | 160 | | 160 | |
| Total Solids | 67.44 | 11.00 | 67.44 | 11.00 | 67.44 | 11.00 |

*Dimethyl terephthalate-ethyleneglycol-neopentylglycol

Table B contains formulations with varying concentrations of aggregating binder polymers and cobinder polymer with high $T_g$, together with varying levels of aggregating dyes. The formulations in Table B were coated on aluminum drums.

TABLE B

| | Aggregate Photoconductive Material Formulations | | | | | | | |
|---|---|---|---|---|---|---|---|---|
| | Example 4 B-1 | | Example 5 B-2 | | Example 6 B-3 | | Example 7 B-4 | |
| | Grams | Wt % | Grams | Wt % | Grams | Wt % | Grams | Wt % |
| "Lexan 145" polycarbonate | 29.70 | 26.81 | 29.70 | 25.79 | 29.70 | 26.81 | 29.70 | 26.81 |
| "Makrolon 5705" polycarbonate | 29.70 | 26.81 | 29.70 | 25.79 | 0 | 0 | 0 | 0 |
| Tetrachlorobisphenol A polycarbonate | 0 | 0 | 0 | 0 | 29.70 | 26.81 | 29.70 | 25.79 |
| Seed | 0.56 | 0.51 | 0.56 | 0.49 | 0.56 | 0.51 | 0.56 | 0.49 |
| Polyester DMT/EG/NPG* | 2.20 | 1.99 | 2.20 | 1.91 | 2.20 | 1.99 | 2.20 | 1.91 |
| 4((4-Dimethylaminophenyl)2, 6-diphenyl) 6-phenylthiapyrylium hexafluorophosphate | 3.52 | 3.18 | 7.04 | 6.11 | 3.52 | 3.18 | 7.04 | 6.11 |
| 4(4-Dimethylaminophenyl)2-(4-ethoxyphenyl) 6-phenylthiapyrylium tetrafluoroborate | 0.88 | 0.79 | 1.76 | 1.53 | 0.88 | 0.79 | 1.76 | 1.53 |
| 1,1-Bis(di-4-tolylamino-phenyl(cyclohexane | 19.80 | 17.88 | 19.80 | 17.19 | 14.30 | 12.91 | 14.30 | 12.42 |
| 4,4'-Bis(diethylamino) tetraphenylmethane | 4.40 | 3.97 | 4.40 | 3.82 | 4.40 | 3.97 | 4.40 | 3.82 |
| Tri-4-tolylamine | 19.80 | 17.88 | 19.80 | 17.19 | 14.30 | 12.91 | 14.30 | 12.42 |
| 1,4-Bis(di-4-tolylamino styryl)benzene | 0 | 0 | 0 | 0 | 11.00 | 9.93 | 11.00 | 9.55 |
| DC-510,phenylmethyl substituted siloxane | 0.20 | 0.18 | 0.20 | 0.17 | 0.20 | 0.18 | 0.20 | 0.17 |
| Dichloromethane | 623 | | 623 | | 623 | | 623 | |
| 1,12-Trichloroethane | 267 | | 267 | | 267 | | 267 | |
| Total Solids | 110.76 | 11.07 | 115.16 | 11.46 | 110.76 | 11.07 | 115.16 | 11.46 |

*Dimethyl terephthalate-ethyleneglycol-neopentylglycol

The formulations listed in Table C contain, in addition to variations in concentration of aggregating binders and cobinder with high $T_g$, mixtures of organic charge transport agents with different $T_g$s. These formulations, like those in Table A, were all coated on a web support and the coatings were subsequently evaluated in a drum format.

TABLE C

| | Aggregate Photoconductive Material Formulations | | | | | | | |
|---|---|---|---|---|---|---|---|---|
| | Example 8, 9 C-1 | | Examples 10, 11 C-2 | | Example 12 C-3 | | Example 13 C-4 | |
| | Grams | Wt % | Grams | Wt % | Grams | Wt % | Grams | Wt % |
| "Lexan 145" polycarbonate | 29.70 | 26.81 | 29.70 | 26.81 | 44.55 | 26.83 | 44.55 | 26.81 |
| "Makrolon 5705" polycarbonate | 29.70 | 26.81 | 0 | 0 | 44.55 | 26.83 | 0 | 0 |
| Tetrachlorobisphenol A polycarbonate | 0 | 0 | 29.70 | 26.81 | 0 | 0 | 44.55 | 26.81 |
| Seed | 0.56 | 0.51 | 0.56 | 0.51 | 0.85 | 0.51 | 0.85 | 0.51 |
| Polyester DMT/EG/NPG* | 2.20 | 1.99 | 2.20 | 1.99 | 3.30 | 1.99 | 3.30 | 1.99 |
| 4((4-Dimethylaminophenyl)2, 6-diphenyl) 6-phenylthiapyrylium hexafluorophosphate | 3.52 | 3.18 | 3.52 | 3.18 | 5.28 | 3.18 | 5.28 | 3.18 |
| 4(4-Dimethylaminophenyl)2-(4-ethoxyphenyl) 6-phenylthiapyrylium tetrafluoroborate | 0.88 | 0.79 | 0.88 | 0.79 | 1.32 | 0.79 | 1.32 | 0.79 |
| 1,1-Bis(di-4-tolylamino-phenyl)cyclohexane | 19.80 | 17.88 | 14.30 | 12.91 | 40.75 | 24.54 | 0 | 0 |
| 4,4'-Bis(diethylamino) tetraphenylmethane | 4.40 | 3.97 | 4.40 | 3.97 | 6.60 | 3.97 | 6.60 | 3.97 |
| Tri-4-tolylamine | 19.80 | 17.88 | 14.30 | 12.91 | 0 | 0 | 51.15 | 30.79 |
| 1,4-Bis(di-4-tolylamino-styryl)benzene | 0 | 0 | 11.00 | 9.93 | 16.50 | 9.94 | 8.25 | 4.97 |
| 1,4-Bis(di-4-tolylamino-phenyl)3-n-propylbenzene | 0 | 0 | 0 | 0 | 2.15 | 1.29 | 0 | 0 |
| DC-510,phenylmethyl substituted siloxane | 0.20 | 0.18 | 0.20 | 0.18 | 0.20 | .018 | 0.30 | 0.18 |
| Dichloromethane | 623 | | 623 | | 623 | | 623 | |
| 1,1,2-Trichloroethane | 267 | | 267 | | 267 | | 267 | |
| Total Solids | 110.76 | 11.07 | 110.76 | 11.07 | 166.05 | 11.06 | 166.05 | 11.06 |

*Dimethyl terephthalate-ethyleneglycol-neopentylglycol

The formulations of Table D, which contain variations in cobinder polymers with varying structures and $T_g$s, were also coated on a web support, and the coatings were subsequently cut into strips for evaluation in a drum format.

TABLE D

| | Aggregate Photoconductive Material Formulations | | | | | | | | | |
|---|---|---|---|---|---|---|---|---|---|---|
| | Example 14 D-1 | | Examples 15 D-2 | | Example 16 D-3 | | Example 17 D-4 | | Example 18 D-5 | |
| | Grams | Wt % | Grams | Wt % | Grams | Wt % | Grams | Wt % | Grams | Wt % |
| "Lexan 145" polycarbonate | 29.70 | 26.82 | 17.82 | 16.09 | 29.70 | 26.82 | 29.70 | 26.82 | 29.70 | 26.82 |
| Tetrachlorobisphenol A polycarbonate | 29.70 | 26.82 | 41.58 | 37.55 | 0 | 0 | 0 | 0 | 0 | 0 |
| 4,4'(Hexahydro-4,7-methano indan-5-ylidene)bisphenol polycarbonate | 0 | 0 | 0 | 0 | 29.70 | 26.82 | 0 | 0 | 0 | 0 |
| 4,4'(Hexahydro-4,7-methano indan-5-ylidene)bisphenol polyterephthalate | 0 | 0 | 0 | 0 | 0 | 0 | 29.70 | 26.82 | 0 | 0 |
| Tetrabromophenolphthalein polyterephthalate | 0 | 0 | 0 | 0 | 0 | 0 | 0 | 0 | 29.70 | 26.80 |
| Seed | 0.55 | 0.50 | 0.55 | 0.50 | 0.55 | 0.50 | 0.55 | 0.50 | 0.55 | 0.50 |
| Polyester DMT/EG/NPG* | 2.20 | 1.99 | 2.20 | 1.99 | 2.20 | 1.99 | 2.20 | 1.99 | 2.20 | 1.99 |
| 4((4-Dimethylaminophenyl)2, 6-diphenyl) 6-phenylthiapyrylium hexafluorophosphate | 3.52 | 3.18 | 3.52 | 3.18 | 3.52 | 3.18 | 3.52 | 3.18 | 3.52 | 3.18 |
| 4(4-Dimethylaminophenyl)2-(4-ethoxyphenyl) 6-phenylthiapyrylium tetrafluoroborate | 0.88 | 0.79 | 0.88 | 0.79 | 0.88 | 0.79 | 0.88 | 0.79 | 0.88 | 0.79 |
| 1,1-Bis(di-4-tolylamino phenyl)cyclohexane | 14.30 | 12.91 | 14.30 | 12.91 | 14.30 | 12.91 | 14.30 | 12.91 | 14.30 | 12.91 |
| 4,4'-Bis(diethylamino) tetraphenylmethane | 4.40 | 3.97 | 4.40 | 3.97 | 4.40 | 3.97 | 4.40 | 3.97 | 4.40 | 3.97 |
| 1,4-Bis(di-4-tolylamino-styryl)benzene | 11.00 | 9.93 | 11.00 | 9.93 | 11.00 | 9.93 | 11.00 | 9.93 | 11.00 | 9.93 |
| 1,4-Bis(di-4-tolylamino-phenyl)3-n-propylbenzene | 14.30 | 12.91 | 14.30 | 12.91 | 14.30 | 12.91 | 14.30 | 12.91 | 14.30 | 12.91 |
| DC-510,phenylmethyl substituted siloxane | 0.20 | 0.18 | 0.20 | 0.18 | 0.20 | 0.18 | 0.20 | 0.18 | 0.20 | 0.18 |
| Dichloromethane | 623 | | 623 | | 623 | | 623 | | 623 | |
| 1,1,2-Trichloroethane | 267 | | 267 | | 267 | | 267 | | 267 | |
| Total Solids | 110.75 | 11.00 | 110.75 | 11.00 | 110.75 | 11.00 | 110.75 | 11.00 | 110.75 | 11.00 |

*Dimethyl terephthalate-ethyleneglycol-neopentylglycol

The seed used in the formulations listed in Tables A, B, C and D was prepared as follows:

To a mixture of 1155 grams of dichloromethane and 493.5 grams of 1,1,2-trichloroethane was added 8.04 grams of 4-((4-dimethylaminophenyl)2,6-diphenyl) 6-phenylthiapyrylium tetrafluoroborate and 5.36 grams of 4-(4-dimethylaminophenyl)-2-(4-ethoxyphenyl)-6-phenylthiapyrylium tetrafluoroborate. The mixture was stirred mechanically for one hour; to the resulting solution was added 102 grams of high molecular weight Bisphenol A polycarbonate, ("Makrolon 5705" polycarbonate, obtained from Mobay Chemical Co.). After one hour additional stirring, 238 grams of Bisphenol A polycarbonate of lower molecular weight ("Lexan 145" polycarbonate, obtained from General Electric Co.) was added. The mixture was stirred overnight, then diluted with 211.5 grams of 1,1,2-trichloroethane. The resulting slurry was allowed to evaporate to dryness, and the residue was cut into small pieces. The high molecular weight polycarbonate referred to above and in the examples hereinafter was "Makrolon 5705" polycarbonate, obtained from Mobay Chemical Co. Its number average molecular weight, as determined by gel permeation chromatography, is 178,000 polystyrene equivalents. The low molecular weight polycarbonate above and in the following examples was "Lexan 145" polycarbonate, obtained from General Electric Co. Its number average molecular weight as determined by gel permeation chromatography is 51,600 polystyrene equivalents.

EXAMPLE 1

Formulation A-1, in which the low molecular weight polycarbonate aggregating binder was the only binder polymer, was coated on a web support. This coating, which had a Tg of 88° C. as calculated according to the Fox equation, was cut into 24.77×15.2 cm (9.75×6 inch) strips, which were wrapped around 80 mm aluminum drums for testing.

EXAMPLE 2

Formulation A-2, which differed from Formulation A-1 of Example 1 only in having one-half of the low molecular weight polycarbonate aggregating binder replaced with an equal weight of high molecular weight polycarbonate was coated as in Example 1. The coating, which had a calculated Tg of 88° C., was prepared for testing as in Example 1.

EXAMPLE 3

The procedure of Example 1 was followed with Formulation A-3, which differed from A-1 only in that one-half of the low molecular weight polycarbonate was replaced with an equal weight of the non-aggregating tetrachlorobisphenol A polycarbonate. The coating, which had a calculated Tg of 106° C., was prepared for testing as in Example 1.

Samples of the coatings of Examples 1, 2 and 3, prepared for testing as described in Example 1, were exposed to low intensity continuous exposures at wavelengths of 460, 540, 600 and 680 nm. Photodischarge curves from 500 to 100 volts were used to calculate electrophotographic speed in the positive charging mode for these coatings and those of all the examples described hereinafter.

The samples were heated in a circulating oven at a temperature of 110° C. for one hour, then set aside in the dark for one hour as they cooled to room temperature. Photodischarge rates from 500 to 100 volts were again measured, electrophotographic speeds were determined and speed losses that resulted from incubation were calculated. The results are shown in Table 2.

For all coatings, there was a significant decrease in the sensitivity of the photoconductors after incubation at 110° C., the losses being more pronounced at 680 nm than at the lower wavelengths. The coating of formulation A-3 of Example 3, however, whose Tg was higher than the others as a result of inclusion of tetrachlorobisphenol A polycarbonate, was much less sensitive to incubation than the other coatings.

TABLE 2

Effect on Incubation on Speed of Single Active Layer Aggregate Photoconductive Elements.

| | | | 500 to 100 Volts Discharge Speed (ergs/cm²) As coated, after incubation; speed loss | | | |
|---|---|---|---|---|---|---|
| Example | Formulation | Tg (°C.) | 460 nm | 540 nm | 600 nm | 680 nm |
| 1 | A-1 | 88 | 9, 10; 11% | 8, 8; 0% | 5, 17; 240% | 4, >40; >900% |
| 2 | A-2 | 88 | 11, 13; 18% | 6, 10; 66% | 5, 17; 240% | 5, >>40; >>700% |
| 3 | A-3 | 106 | 10, 10; 0% | 6, 8; 33% | 8, 8; 0% | 5, 13; 160% |

EXAMPLE 4

Formulation B-1, which contained a 1:1 mixture of low molecular weight polycarbonate and high molecular weight polycarbonate aggregating binders and about 4 weight percent total of aggregating dyes, was coated on a 108 mm diameter aluminum drum, using a ring coater mounted with a Teflon® gasket, at a speed of 2.5 cm/sec (1 in/sec). The coating, which had a calculated $T_g$ of 88° C., was dried in a circulating oven at a temperature of 110° C. for one hour, then stored in the dark as it cooled to room temperature.

EXAMPLE 5

Formulation B-2, which differed from Formulation B-1 of Example 4 only in having an increased level of aggregating dyes, about 7.6 weight percent total. Formulation B-2 was coated and its coating dried as in Example 4. The calculated $T_g$ of this coating was 88° C.

EXAMPLE 6

The procedure of Example 4 was followed with Formulation B-3, which differed from B-1 only in that the high molecular weight polycarbonate aggregating binder was replaced with an equal weight of tetrachlorobisphenol A polycarbonate. The calculated $T_g$ of this coating was 112° C.

EXAMPLE 7

The procedure of Example 4 was followed with Formulation B-4, which differed from B-1 only in that an equal weight of tetrachlorobisphenol A polycarbonate was used in place of the high molecular weight polycarbonate aggregating binder and the level of aggregating dyes was increased to about 7.6 weight percent total.

The drum coatings of Examples 4, 5, 6 and 7, which had been dried at 110° C. for one hour and then stored in the dark and allowed to cool to room temperature, were evaluated with regard to their electrophotographic speed stability. Photodischarge curves from 500 to 100 volts were obtained for each coating after low intensity continuous exposures at wavelengths of 460, 540, 600, and 680 nm at the following time intervals after removal from the drying oven: 90 minutes, one day, 2 days, and 3 days. The results from exposures at 680 nm are shown in Table 3.

The coating of Example 4 required more than 2,000 ergs/cm² to discharge from 500 to 100 volts when tested 90 minutes after drying. The energy requirement dropped to 31 ergs/cm² after 3 days, demonstrating the temporal speed instability of this coating. The coating of Example 5, which contained the higher level of aggregating dyes, needed much more than 2,000 ergs/cm² to discharge after 90 minutes. Even after 3 days, more than 1,500 ergs/cm² was required, demonstrating the very poor electrophotographic speed of this coating.

The coating of Example 6, which had a higher $T_g$ than those of the two previous examples because of the inclusion of tetrachlorobisphenol A polycarbonate, exhibited excellent speed, which did not vary over the time period from 90 minutes to 3 days after drying. The Example 7 coating, which contained the higher level of aggregating dyes, had poorer speed and variability with time than that of the previous examples, but its speed and stability were far superior to that of Example 4, whose $T_g$ was well below the drying temperature.

TABLE 3

Effect of Aging and Dye Level on Speed of Dried Single Active Layer Aggregate Photoconductive Drum Elements.

| | | | 500 to 100 Volts Discharge Speed (ergs/cm²) at 680 nm Time After Drying | | | |
|---|---|---|---|---|---|---|
| Example | Formulation | Tg (°C.) | 90 minutes | 1 day | 2 days | 3 days |
| 4 | B-1 | 88 | >2000 | 958 | 177 | 31 |
| 5 | B-2 | 88 | >>2000 | 2052 | 2018 | 1539 |
| 6 | B-3 | 112 | 8 | 8 | 8 | — |
| 7 | B-4 | 112 | 218 | 22 | 15 | — |

EXAMPLE 8

Formulation C-1, which contained a 1:1 mixture of the low molecular weight polycarbonate and high molecular weight polycarbonate aggregating binders, was coated on a web support at a thickness of 10 μm. The coating, which had a $T_g$ of 88° C., was prepared for testing as in Example 1.

EXAMPLE 9

The procedure of Example 8 was followed, except that Formulation C-1 was coated on a web support at a thickness of 16 μm. This coating had a $T_g$ of 88° C.

EXAMPLE 10

The procedure of Example 8 was followed with Formulation C-2, which differed from C-1 only in that the high molecular weight polycarbonate aggregating binder was replaced with an equal weight of tetrachlorobisphenol A polycarbonate. The $T_g$ of the coating of C-2 was 112° C.

EXAMPLE 11

Formulation C-2 was coated on a web support at a thickness of 16 μm. The coating, which had a $T_g$ of 112° C., was prepared for testing as in Example 1.

Samples of the coatings of Examples 8, 9, 10 and 11, prepared for testing as described in Example 1, were heated in a circulating oven at a temperature of 110° C. for one hour, then stored in the dark and allowed to cool to room temperature. Photodischarge curves from 500 to 100 volts were obtained for each coating after low intensity continuous exposures at wavelengths of 460, 540, 600, and 680 nm at the following time intervals after removal from the drying oven: one hour, 17 hours, 72 hours, and 168 hours. The results from exposures at 680 nm are recorded in Table 4.

TABLE 4

Effect of Aging and Coating Thickness on Speed of Incubated Single Active Layer Aggregate Photoconductive Elements.

| Example | Formulation and Coating Thickness | Tg (°C.) | 500 to 100 Volts Discharge Speed (ergs/cm²) at 680 nm Time After Drying: 1 hour | 17 hours | 72 hours | 168 hours |
|---|---|---|---|---|---|---|
| 8 | C-1, 10 μm | 88 | 119 | 49 | 41 | 10.8 |
| 9 | C-1, 16 μm | 88 | 1012 | 781 | 577 | 47.3 |
| 10 | C-2, 10 μm | 112 | 29 | 6.8 | 6.8 | 7 |
| 11 | C-2, 16 μm | 112 | 82.2 | 23.2 | 6.3 | 6.3 |

As recorded in Table 4, the 10 μm-thick coating of Example 8 showed a considerable loss of electrophotographic speed as the coating aged from one to 168 hours after incubation. Its 16 μm-thick counterpart coating of Example 9 exhibited much poorer speed and much greater temporal instability.

The 10 μm-thick coating of Example 10, which had a higher $T_g$ than that of Example 8, showed a slight speed shift early in the post-incubation period, but within 17 hours attained very good speed, which did not change with aging. Its 16 μm-thick counterpart of Example 11 exhibited somewhat greater initial speed variability but within 72 hours after incubation showed good, unvarying speed. Thus, the coatings of Examples 10 and 11, whose $T_g$ was increased by the inclusion of tetrachlorobisphenol A polycarbonate in their formulations, showed much superior speed and stability to those of Examples 8 and 9, whose $T_g$ was well below the incubation temperature.

EXAMPLE 12

Formulation C-3, which contained a 1:1 mixture of the low molecular weight polycarbonate and the high molecular weight polycarbonate aggregating binders, differed from formulation C-1 of Examples 8 and 9 in containing none of the low $T_g$ organic charge transport agent tri-4-tolylamine but an increased level of the higher $T_g$ charge transport agent 1,4-bis(di-4-tolylaminophenyl) 3-n-propylbenzene. Formulation C-3 was coated on a web support at a thickness of 16 μm. The coating, which had a calculated $T_g$ of 111° C., was prepared for testing as in Example 1.

EXAMPLE 13

Formulation C-4, which contained a 1:1 weight ratio of the low molecular weight aggregating polycarbonate and tetrachlorobisphenol A polycarbonate, differed from formulation C-2 of Examples 10 and 11 in containing none of the organic charge transport agent 1,4-bis(-di-4-tolylaminophenyl)-3-n-propylbenzene and an increased level of the low $T_g$ charge transport agent tri-4-tolylamine. Formulation C-4 was coated on a web support at a thickness of 16 μm. The coating, which had a calculated $T_g$ of 88° C., was prepared for testing as in Example 1.

Samples of the coatings of Examples 9, 11, 12 and 13, prepared for testing as described in Example 1, were heated in a circulating oven at a temperature of 110° C. for one hour, then stored in the dark and allowed to cool to room temperature. Photodischarge curves from 500 to 100 volts were obtained for each coating after low intensity continuous exposures at wavelengths of 460, 540, 600 and 680 nm at the following time intervals after removal from the drying oven: one hour, 17 hours, 72 hours, and 168 hours. The results from exposures at 680 nm are given in Table 5.

The coatings of Example 9 and 12 contained the same levels of the same binder polymers, but the $T_g$ of the latter coating was raised by the substitution of an organic charge transport agent of lesser $T_g$ with one of higher $T_g$. As the data in Table 5 show, this method of increasing the $T_g$ of the continuous phase of the photoconductive coating resulted in the improved electrophotographic speed and temporal stability of the coating of Example 12 compared with that of Example 9.

TABLE 5

Effect of Aging and Photoconductor Variations on Speed of Incubated Single Active Layer Aggregate Photoconductive Elements.

| Example | Formulation | Tg (°C.) | 500 to 100 Volts Discharge Speed (ergs/cm²) at 680 nm Time After Drying: 1 hour | 17 hours | 72 hours | 168 hours |
|---|---|---|---|---|---|---|
| 9 | C-1 | 88 | 1012 | 781 | 577 | 47.3 |
| 11 | C-2 | 112 | 82.2 | 23.2 | 6.3 | 6.3 |
| 12 | C-3 | 111 | 370 | 197 | 22 | 7 |
| 13 | C-4 | 88 | 604 | 329 | 288 | 63 |

Similarly, the coatings of Examples 11 and 13 contained the same levels of low molecular weight aggregating polycarbonate and tetrachlorobisphenol A polycarbonate, but the $T_g$ of the latter coating was lowered by increasing the level of a low $T_g$ organic charge transport agent. In this instance, the lowered $T_g$ of the photoconductive coating resulted in much poorer electrophotographic speed and stability with the coating of Example 13 compared with that of Example 11. Both of these experiments demonstrated that the composite $T_g$ of the continuous phase of an aggregate photoconductive coating, not the $T_g$s of individual binder and photoconductor components, determined its performance in response to drying at temperatures of about 110° C.

To test the effect of the rate of cooling on the electrophotographic speed of photoconductive coatings of varying compositions and $T_g$s, two samples each of the coatings of Examples 8 and 10 were heated in an oven at a temperature of 110° C. for one hour. One of each of the samples was removed from the oven at the end of the heating period and allowed to cool at the ambient condition of the room. They equilibrated to room temperature (28° C.) within one hour. The other samples were left in the oven, but the power was shut off; more than 6 hours was required for these samples to reach room temperature.

Twelve hours after the "slow cooled" samples had cooled to room temperature, both the "fast cooled" and "slow cooled" samples were exposed to low intensity continuous exposures at wavelengths of 460, 540, 600, and 680 nm. Photodischarge rates from 500 to 100 volts were used to measure electrophotographic speeds and determine the effects of incubation and rates of coating on the stability of the photoconductive coatings. The results of these tests are given in Table 6.

The coating of Example 8 which had been "fast cooled" after incubation showed very large decreases in sensitivity, particularly at 680 nm. However a sample of the same coating that had been "slow cooled" after incubation exhibited very good speed, demonstrating that the detrimental effect of drying at 110° C. observed under the usual cooling conditions could be overcome to a considerable extent by allowing the incubated coating to equilibrate to room temperature over a long period of time. On the other hand, the coating of Example 10, whose $T_g$ was very slightly higher than the drying temperature, exhibited excellent electrophotographic speed irrespective of cooling rate. These results demonstrated the superiority of the higher $T_g$ coating of Example 10 compared with that of the lower $T_g$ coating of Example 8, in that the Example 10 coating maintained its excellent photographic speed regardless of the mode of cooling.

TABLE 6

Effect of Cooling Rate on Speed of Incubated Single Active Layer Aggregate Photoconductive Elements.

| Example | Formulation and Cooling Condition | Tg (°C.) | 500 to 100 Volts Discharge Speed (ergs/cm²) As coated, After incubation; Speed loss | | | |
|---|---|---|---|---|---|---|
| | | | 460 nm | 540 nm | 600 nm | 680 nm |
| 8 | C-1, "Fast" | 88 | 10, 15; 50% | 6, 11; 83% | 5, 16; 220% | 5, 116; 2220% |
| 8 | C-1, "Slow" | 88 | 10, 12; 20% | 6, 7; 17% | 5, 6; 20% | 5, 7; 40% |
| 10 | C-2, "Fast" | 112 | 5, 6; 20% | 6, 6; 0% | 4, 6; 50% | 5, 5; 0% |
| 10 | C-2, "Slow" | 112 | 5, 8; 60% | 6, 6; 0% | 4, 5; 25% | 5, 4; −20% |

EXAMPLE 14

Formulation D-1, which contained a mixture of the low molecular weight aggregating polycarbonate and tetrachlorobisphenol A polycarbonate in a 1:1 weight ratio, was coated on a web support. The coating, which had a $T_g$ of 125° C., was prepared for testing as in Example 1.

EXAMPLE 15

Formulation D-2, which differed from D-1 only in having the mixture of low molecular weight aggregating polycarbonate and tetrachlorobisphenol A polycarbonate in a 70:30 weight ratio, was coated on a web support. The coating, which had a $T_g$ of 133° C., was prepared for testing as in Example 1.

EXAMPLE 16

Formulation D-3, which differed from D-1 only in having an equal weight of 4,4'-(hexahydro-4,7-methanoindan-5-ylidene)bisphenol polycarbonate in place of tetrachlorobisphenol A polycarbonate, was coated on a web support. The coating, which had a $T_g$ of 129° C., was prepared for testing as in Example 1.

EXAMPLE 17

Formulation D-4, which differed from D-1 only in having an equal weight of 4,4'-(hexahydro-4,7-methanoindan-5-ylidene)bisphenol polyterephthalate in place of tetrachlorobisphenol A polycarbonate, was coated on a web support. The coating, which had a $T_g$ of 135° C., was prepared for testing as in Example 1.

EXAMPLE 18

Formulation D-5, which differed from D-1 only in having an equal weight of tetrabromophenolphthalein polyterephthalate in place of tetrachlorobisphenol A polycarbonate, was coated on a web support. The coating, which had a $T_g$ of 135° C., was prepared for testing as in Example 1.

Samples of the coatings of Examples 14, 15, 16, 17, and 18, prepared for testing as described in Example 1, were exposed to low intensity continuous exposures at wavelengths of 460, 540, 600, and 680 nm. Photodischarge curves from 500 to 100 volts were used to calculate electrophotographic speed.

The samples were heated in a circulating oven at a temperature of 110° C. for one hour, then set aside in the dark for one hour as they cooled to room temperature. Photodischarge rates from 500 to 100 volts were again measured, electrophotographic speeds were determined, and speed losses that resulted from incubation were calculated. The results are given in Table 7.

The continuous phase of the aggregate photoconductive coatings of this experiment all had $T_g$s well above the incubation temperature of 110° C. The speed decreases resulting from incubation were generally small for all coatings, although the coatings of Examples 14, 15, and 16, which contained polycarbonate cobinders, had a slight advantage in speed and incubation stability over the coatings of Example 17 and 18, where the cobinders were polyterephthalates. The experiment demonstrates the beneficial effects on electrophotographic speed and stability of using high $T_g$ cobinder polymers of various structures.

TABLE 7

Effect of Incubation and Binder Polymer Variations on Speed of Single Active Layer Aggregate Photoconductive Elements.

| Example | Formulation | Tg (°C.) | 500 to 100 Volts Discharge Speed (ergs/cm²) As coated, After incubation; Speed loss | | | |
|---|---|---|---|---|---|---|
| | | | 460 nm | 540 nm | 600 nm | 680 nm |
| 14 | D-1 | 125 | 8, 10; 25% | 8, 9; 13% | 6, 6; 0% | 5, 5; 0% |
| 15 | D-2 | 133 | 9, 12; 33% | 10, 13; 30% | 7, 9; 29% | 6, 6; 0% |
| 16 | D-3 | 129 | 10, 12, 20% | 8, 10; 25% | 8, 8; 0% | 7, 7; 0% |
| 17 | D-4 | 135 | 26, 31; 19% | 11, 12; 9% | 10, 16; 60% | 8, 17; 113% |

TABLE 7-continued

Effect of Incubation and Binder Polymer Variations on Speed of Single Active Layer Aggregate Photoconductive Elements.

| Example | Formulation | Tg (°C.) | 500 to 100 Volts Discharge Speed (ergs/cm$^2$) As coated, After incubation; Speed loss | | | |
|---|---|---|---|---|---|---|
| | | | 460 nm | 540 nm | 600 nm | 680 nm |
| 18 | D-5 | 135 | 23, 31; 35% | 20, 32; 60% | 14, 14; 0% | 11, 12; 9% |

The invention has been described in detail with particular reference to preferred embodiments thereof, but it will be understood that variations and modifications can be effected within the spirit and scope of the invention.

I claim:

1. An electrophotographic element comprising a single active photoconductive layer on an electrically conductive support wherein said layer comprises (1) an aggregate photoconductive material comprising an electrically insulating, continuous polymer phase and heterogeneously dispersed therein a complex of (i) at least one polymer having an alkylidene diarylene group in a recurring unit, and (ii) at least one pyrylium dye salt, and (2) at least one organic charge transport agent in said continuous polymer phase, and said continuous polymer phase having a glass transition temperature, $T_g$, of at least about 110° C.

2. An electrophotographic element of claim 1 wherein said continuous polymer phase is a mixture of at least two polymers, at least one of which is an aggregating polycarbonate.

3. The element of claim 1 wherein said polymer is a bisphenol A polycarbonate and said dye salt is a thiapyrylium salt.

4. The element of claim 2 wherein at least one of said polymers has a glass transition temperature of at least about 195° C.

5. The element of claim 4 wherein at least one of the polymers that has a glass transition temperature of at least about 195° C. is a bisphenol polycarbonate.

6. The element of claim 5 wherein said bisphenol polycarbonate is a polyhalogenated derivative of bisphenol A polycarbonate.

7. The element of claim 3 wherein said thiapyrylium salt is 4-((4-dimethylaminophenyl)-2,6-diphenyl)-6-phenylthiapyrylium hexafluorophosphate or 4-(4-dimethylaminophenyl)-2-(4-ethoxyphenyl) -6-phenylthiapyrylium tetrafluoraborate.

8. The element of claim 7 wherein the photoconductive layer contains at least one of the organic charge transport agents tri-4-tolylamine, 1,1-bis (di-4-tolylaminophenyl)cyclohexane, 1,4-bis (di-4-tolylaminostyryl)benzene, 1,1-bis (di-4-tolylaminophenyl)-3-n-propylbenzene or 4,4'-bis(diethylamino)tetraphenylmethane.

9. The element of claim 8 wherein the electrically conductive support has a cylindrical surface.

10. A method of forming an electrophotographic element having a single aggregate photoconductive layer on an electrically conductive support which comprises forming a mixture comprising (1) a plurality of binder polymers, at least one of which is an aggregating polycarbonate, (2) at least one aggregating pyrylium dye salt, (3) at least one organic charge transport agent, and (4) a volatile coating solvent, coating and drying said mixture on said support, and thereby forming an aggregate photoconductive layer in which the continuous polymer phase has a glass transition temperature of at least about 110° C., and drying the layer at a temperature of at least about 100° C.

11. A method of forming an electrophotographic element according to claim 10 in which said mixture additionally comprises particles of an aggregate photoconductive seed composition.

12. The method of claim 11 wherein the drying temperature is from about 110° C. to about 145° C.

13. The method of claim 10 wherein said aggregating polycarbonate is a bisphenol polycarbonate.

14. The method of claim 10 wherein at least one of the binder polymers has a glass transition temperature of at least about 195° C.

15. The method of claim 14 wherein the binder polymer that has a glass transition temperature of at least about 195° C. is a bisphenol polycarbonate.

16. The method of claim 15 wherein said bisphenol polycarbonate is a polyhalogenated derivative of bisphenol A polycarbonate.

17. A method of forming an electrophotographic element having a single aggregate photoconductive layer comprising an electrically insulating, continuous polymer phase in which is heterogeneously dispersed a complex of an aggregating binder polymer having an alkylidene diarylene group in a recurring unit and an aggregating pyrylium dye salt on an electrically conductive support, which method comprises:

(1) forming a mixture comprising said aggregating binder polymer, said aggregating pyrylium dye salt, an organic charge transport agent, and a volatile coating solvent;

(2) coating said mixture on said support to form said aggregate photoconductive layer wherein said continuous phase has a glass transition temperature of at least about ₁10° C.; and (3) drying said photoconductive layer at a temperature of at least about 100° C.

* * * * *